US012035822B1

(12) United States Patent
Reno

(10) Patent No.: US 12,035,822 B1
(45) Date of Patent: Jul. 16, 2024

(54) ASSEMBLY KIT FOR CONSTRUCTING A FOOD OR BEVERAGE WALL

(71) Applicant: Robert Reno, Southfield, MI (US)

(72) Inventor: Robert Reno, Southfield, MI (US)

( * ) Notice: Subject to any disclaimer, the term of this patent is extended or adjusted under 35 U.S.C. 154(b) by 0 days.

(21) Appl. No.: 18/109,969

(22) Filed: Feb. 15, 2023

(51) Int. Cl.

| | |
|---|---|
| ***A47F 5/08*** | (2006.01) |
| ***A47B 57/26*** | (2006.01) |
| ***A47F 7/00*** | (2006.01) |
| ***A47F 7/28*** | (2006.01) |
| *A47B 47/00* | (2006.01) |
| *A47G 23/02* | (2006.01) |

(52) U.S. Cl.
CPC ..... *A47F 5/0838* (2013.01); *A47B 57/26* (2013.01); *A47F 7/0071* (2013.01); *A47F 7/28* (2013.01); *A47B 47/00* (2013.01); *A47G 23/0208* (2013.01)

(58) Field of Classification Search
CPC ..... A47F 5/0838; A47F 7/0071; A47F 7/28; A47F 7/283; A47B 47/00; A47B 47/0041; A47B 47/0091; A47B 57/06; A47B 57/08; A47B 57/10; A47B 57/16; A47B 57/26; A47B 57/32; A47B 57/34; A47G 23/0208
See application file for complete search history.

(56) References Cited

U.S. PATENT DOCUMENTS 1,324,537 A * 12/1919 Belcher ..... A47B 57/42 211/187
D100,777 S * 8/1936 Jewett ..... D6/571
2,177,678 A * 10/1939 Uhri, Jr. ..... A47B 57/00 108/106
2,894,642 A * 7/1959 Clevett, Jr. ..... A47B 57/26 108/106
3,421,632 A * 1/1969 Wood ..... A47B 81/005 248/110
3,690,407 A * 9/1972 Eugene ..... E04G 1/152 182/178.4
4,003,612 A * 1/1977 Munsell ..... A01K 97/08 43/25
D249,001 S * 8/1978 Offredi ..... D6/661
D272,787 S * 2/1984 Rumbaugh ..... D6/552
4,685,400 A * 8/1987 Unander-Scharin ... A47B 57/30 108/147.11
4,715,474 A * 12/1987 Wehmeyer ..... E04G 7/306 403/268
4,762,235 A * 8/1988 Howard ..... A47B 57/46 211/59.3
4,871,074 A * 10/1989 Bryson ..... A45D 20/12 211/70.6

(Continued)

*Primary Examiner* — Devin K Barnett
(74) *Attorney, Agent, or Firm* — Dinsmore & Shohl LLP

(57) ABSTRACT

An assembly kit for constructing a food or beverage wall including a pair of vertically extending framing sections with pedestal base supports. A plurality of horizontally arrayed and tier defining shelves are assembled in extending fashion between the framing sections, the shelves adapted for supporting the food or beverage items. At least one stacked plurality of intermediate located and inter assembleable vertical pole supports interconnect through aligning apertures configured in the individual shelves to provide reinforcing support. The stacked pole supports each including a narrowed upper diameter projecting portion frictionally engaged with an opposing underside pocket configured in a successively engaged pole support.

17 Claims, 9 Drawing Sheets

(56) References Cited

U.S. PATENT DOCUMENTS 4,934,015 A * 6/1990 Mink ..... A47L 4/04 15/268
5,188,020 A 2/1993 Buchnag
5,451,380 A * 9/1995 Zinnanti ..... A61B 50/20 206/370
5,487,475 A * 1/1996 Knee ..... A47B 81/005 D6/552
5,678,700 A * 10/1997 Crosson, Jr. ..... A01K 97/10 211/60.1
5,715,953 A * 2/1998 Brown ..... A47F 7/28 211/74
5,797,501 A * 8/1998 Von Gunten ..... A47B 57/42 211/183
5,918,750 A * 7/1999 Jackson ..... A47F 5/0807 108/108
6,189,945 B1 * 2/2001 Rockett ..... B60R 11/06 296/3
6,360,902 B1 * 3/2002 Searles ..... A01K 97/10 211/70.8
D493,056 S * 7/2004 Shornak ..... D6/552
6,889,982 B1 * 5/2005 Gove ..... A63B 63/00 273/400
7,213,592 B2 * 5/2007 Fischhaber ..... F24C 15/16 126/337 R
7,338,110 B1 * 3/2008 Eckloff ..... B60R 11/00 296/3
7,448,634 B1 * 11/2008 Raub ..... A47F 5/083 211/186
7,866,074 B2 * 1/2011 McComb ..... B43L 1/045 40/606.01
8,756,951 B2 6/2014 Bortoletto et al.
9,723,950 B2 8/2017 Tippman et al.
10,214,934 B2 * 2/2019 Hunt ..... G09F 15/0012
D887,796 S * 6/2020 Chiang ..... D7/701
11,390,515 B2 7/2022 Lynch et al.
11,517,660 B2 * 12/2022 Nasker ..... A61M 5/008
11,607,037 B2 * 3/2023 Baez ..... A47B 47/045
2003/0015372 A1 * 1/2003 Herrmann ..... A62B 35/0068 182/186.7
2004/0163889 A1 * 8/2004 Wallther ..... E04G 5/142 182/113
2005/0211140 A1 * 9/2005 McDonald ..... A47B 57/20 108/108
2006/0033359 A1 * 2/2006 Taylor ..... B60P 3/14 296/182.1
2006/0070965 A1 * 4/2006 Keegan ..... A47F 7/0028 211/60.1
2006/0113263 A1 * 6/2006 Kratochvil ..... A47G 23/0208 211/85.29
2007/0069542 A1 * 3/2007 Steiger ..... B60R 11/06 296/24.44
2008/0048081 A1 * 2/2008 Costa ..... A47B 96/06 248/241
2010/0209662 A1 * 8/2010 Slade ..... A47G 23/02 428/131
2011/0088973 A1 * 4/2011 Shih ..... E04G 5/10 182/115
2012/0097628 A1 * 4/2012 Blacknell ..... A47G 25/0685 211/85.3
2013/0126270 A1 * 5/2013 Darby ..... E04G 5/14 256/65.01
2015/0060440 A1 3/2015 Lippold et al.
2016/0007740 A1 * 1/2016 Consaul ..... B65D 19/40 211/187
2016/0157606 A1 * 6/2016 Kaelin ..... A47B 73/00 211/74
2016/0189087 A1 * 6/2016 Morton ..... G06Q 10/083 705/337
2017/0135553 A1 * 5/2017 Mesa ..... A47L 15/50
2018/0186618 A1 7/2018 Chow
2021/0186211 A1 * 6/2021 Baez ..... A47B 57/545

* cited by examiner

FIG. 12
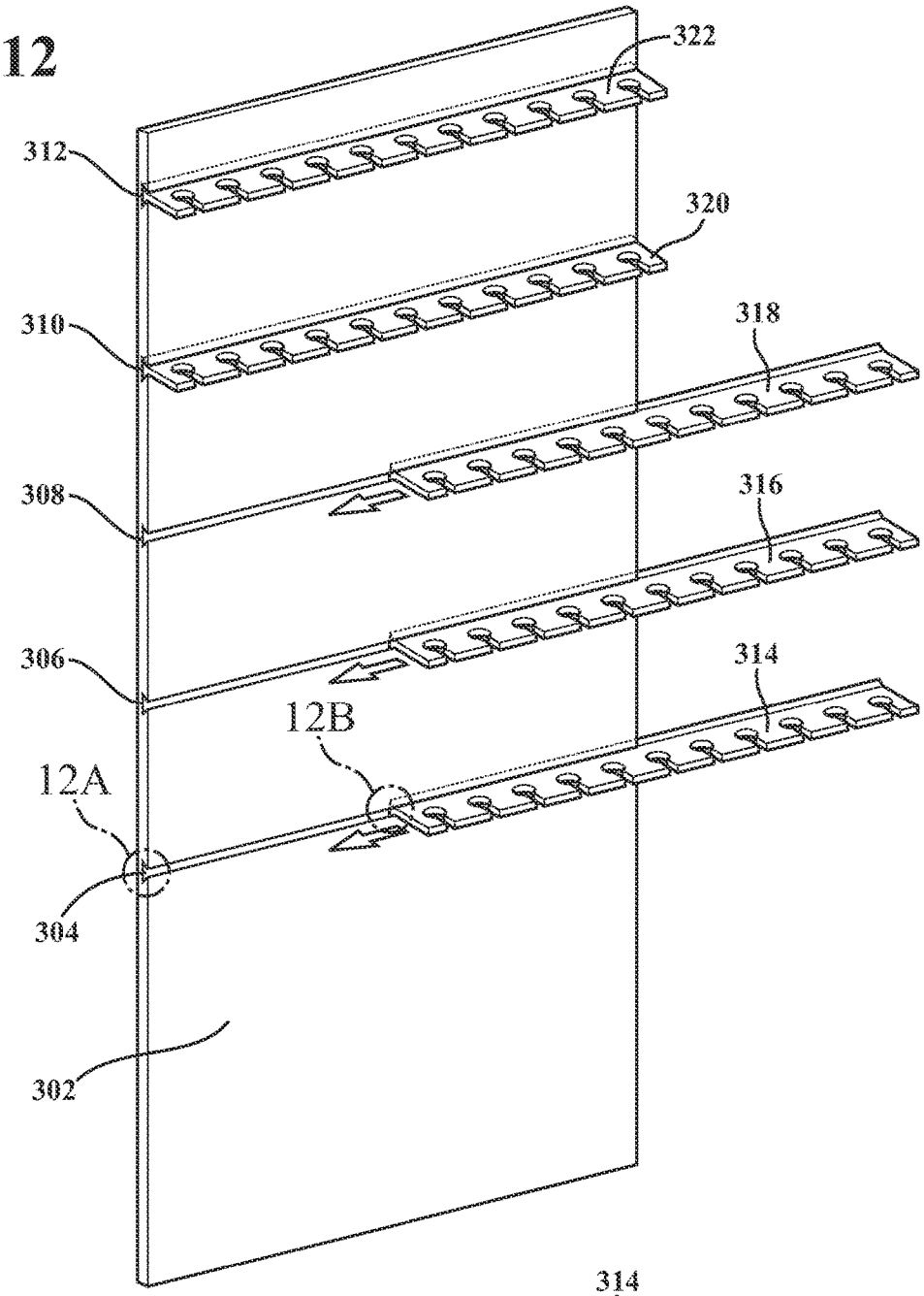
FIG. 12A
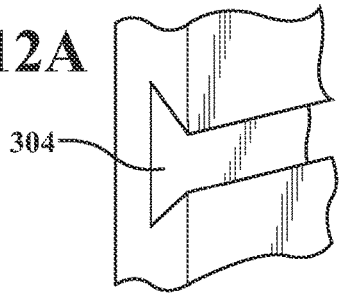
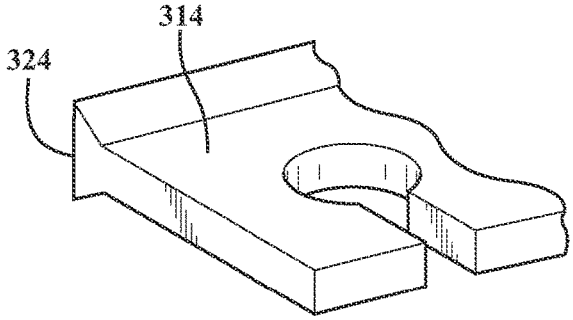
FIG. 12B

ASSEMBLY KIT FOR CONSTRUCTING A FOOD OR BEVERAGE WALL

FIELD OF THE INVENTION

The present invention relates generally to assembleable displays, such as provided for celebratory events and the like. More specifically, the present invention teaches a kit and assembly for quickly and efficiently constructing a food, beverage or display wall, such as in particular commonly referred to as a champagne wall.

BACKGROUND OF THE INVENTION

Beverage wall constructions are known in the art, such as for use in celebratory events including weddings and the like. A first commercially known example is the TreatWalls design depicted in www.treatwalls.com/collections/champagne-walls. Other known versions of the TreatWalls design is shown in www.treatwalls.com/products/champange-wall-with-stand, and which teaches a one piece bookshelf-style construction with vertical cutouts at spaced intervals along each shelf for supporting the stem and body underside of a plurality of champagne flutes. Other champagne wall constructions teach additional variations of a one piece stand or frame, referencing being had to www.etsy.com/market/champagne_wall.

SUMMARY OF THE INVENTION

The present invention discloses an assembly kit for quickly and efficiently constructing a food or beverage wall, such as in particular commonly referred to as a champagne wall. An advantage of the present kit and assembly is the ability to ship or transport and to provide for quick and easy assembly by the end user, this in contrast to more bulky and expensive prior art champagne wall designs which are typically transported in assembled fashion to the event location. As is known, such assemblies are usually rented for special events, typically weddings or other celebratory functions, in which factors such as (rental) cost and ease of transportability take precedence. The ability to package and ship such a food/beverage wall which can be assembled by the end user with a minimum of skill and effort thereby provides a distinct commercial advantage over bulky prior art assemblies.

In a first embodiment, the assembly kit is provided as a multi-component construction including each of primary inter assemble-able end tubular sections with pedestal base supports, an upper-most horizontal interconnecting support extending between the end supports, a plurality of horizontal and width extending shelving sections for supporting the food or beverage items in a tiered arrangement and which are attached via configured clamps to the primary end tubular sections, and additional intermediate inter assemble-able vertical pole supports which interconnect through apertures configured in the shelving sections to provide reinforcing support to the overall assembly.

The individual shelving sections can be designed in any suitable fashion in order support any desired item for acquisition by guests or participants of the event and, in a non-limiting preferred embodiment, can include forward-most notches which communication with interior spaced apart circular cutouts for supporting a plurality of such as champagne flutes. As is further shown, each of the individually tiered shelving sections can be further provided in subdivided and end-to-end inter-connected sub-sections with the assistance of horizontal reinforcing and "U" shaped tracks, both to assist in reducing the overall length of the shipped assembly as well as to provide the necessary structural support when assembled. In a preferred variant, the sub-divided tier sections can be pivotally attached so as to be rotated between a reduced length storage or transport configuration and an assembled and extended use position.

A food or beverage wall according to a further embodiment discloses a plurality of pivotally supported shelfs relative to a rigid supported backboard, with the shelves being pivoted between stored and use positions. The shelves can be similarly configured for receiving such as champagne flutes in the downwardly folded use position. The shelves can be folded, typically upwardly, in a non-use or stored position, which also minimizes the cross sectional profile for providing ease of shipping.

A yet further embodiment of the present kit and assembly provides a pair of spaced apart and vertical extending lanyards, such as which include upper hook ends for attachment to hang in a suspended position from a pole or fixed structure, and between which are secured redesigned flute supporting shelves. Swaying of the assembly can be attenuated by the inclusion of weighted, typically decorative, fobs at the lowermost ends of the lanyards.

BRIEF DESCRIPTION OF THE DRAWINGS

Reference will now be made to the attached drawings, when read in combination with the following detailed description, wherein like reference numerals refer to like parts throughout the several views, and in which:

FIG. 12 is a perspective illustration of a food or beverage wall according to a further embodiment and which discloses a redesigned rigid supporting backboard with horizontal extending recessed tracks within which is slidably engaged each of the tier defining shelves;

FIGS. 12A and 12B depict first and second enlarged partial views of each of dovetail shaped and horizontal recessed tracks and mating engaging rear end profiles configured in the slide-in shelving sections.

DETAILED DESCRIPTION OF THE PREFERRED EMBODIMENTS

With reference to the attached illustrations, the present invention discloses an assembly kit for quickly and efficiently constructing a food or beverage wall, such as in particular commonly referred to as a champagne wall. As previously described, an advantage of the present kit and assembly is the ability to ship or transport the same (such as utilizing cardboard packaging or the like) and to provide for quick and easy assembly by the end user on site, this in contrast to more bulky and expensive prior art champagne wall designs which are typically transported in assembled fashion to the event location, such as by a caterer or other event organizer, typically at a much higher cost.

As also previously described, such assemblies are usually rented for special events, typically weddings or other celebratory functions, in which factors such as (rental) cost and ease of transportability take precedence. In this manner, the ability to package and ship such a food/beverage wall, such as which can be assembled by the end user with a minimum of skill and effort, provides a distinct commercial advantage over bulky prior art assemblies.

Figure 1:
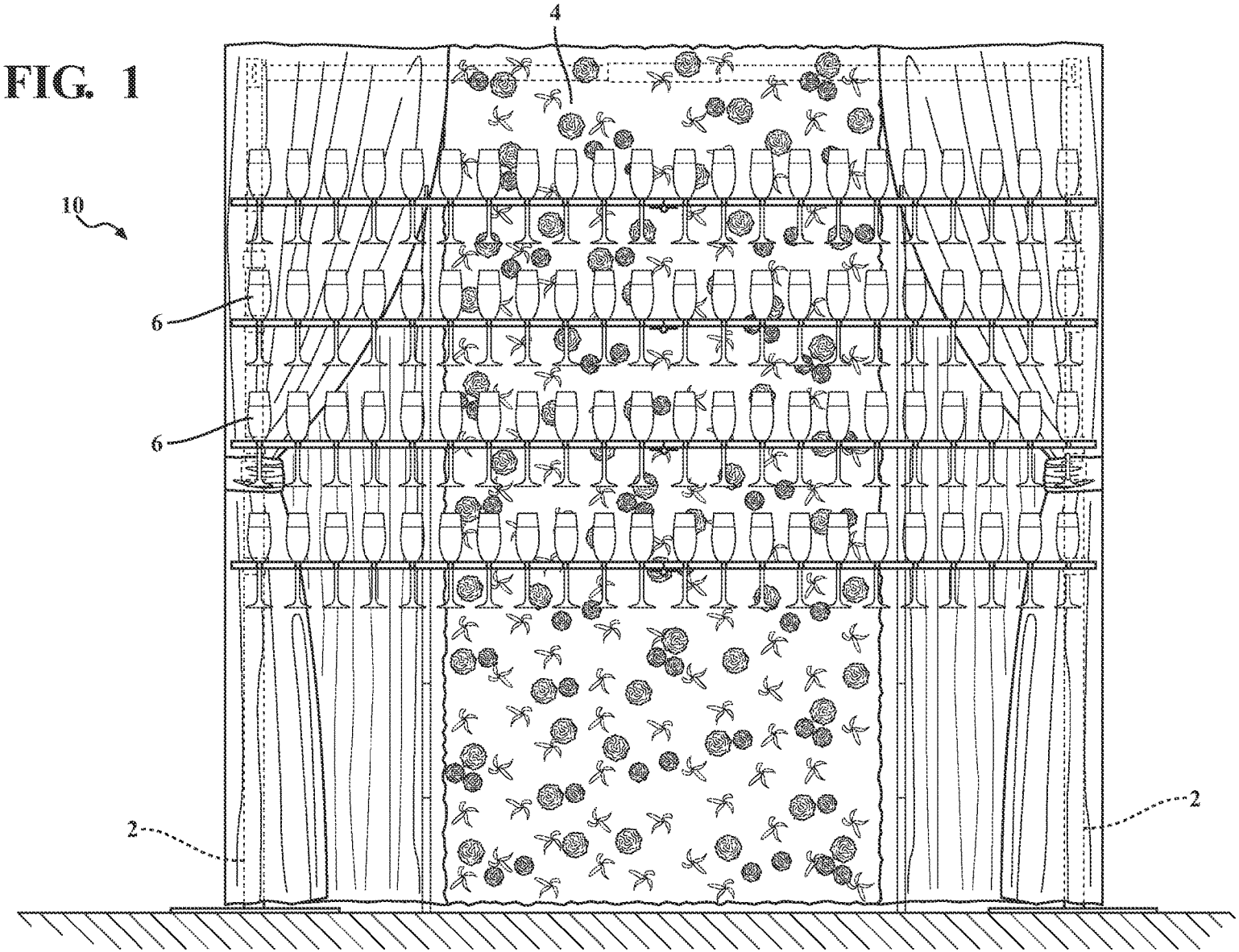
FIG. 1 is a plan view of an assembly kit for constructing a food or beverage wall according to one non-limiting embodiment of the present invention.

With reference initially to FIG. 1, along with succeeding FIGS. 2-8, a kit and assembly is generally depicted at 10 according to a first embodiment provided as a multi-component construction. The assembled and use configuration of FIG. 1, depicts the kit and assembly to include such as background indicia (see curtains 2 and background scenery 4). The completed assembly is also configured to support a volume of food or beverage items, in the illustrated embodiments depicted as champagne flutes 6, with it being understood that the tiered shelving units making up the present invention can be configured to support any item not limited to champagne, other drink or food items (e.g. salads or desserts), to include also decoration, display, gift items and the like.

Figure 2:
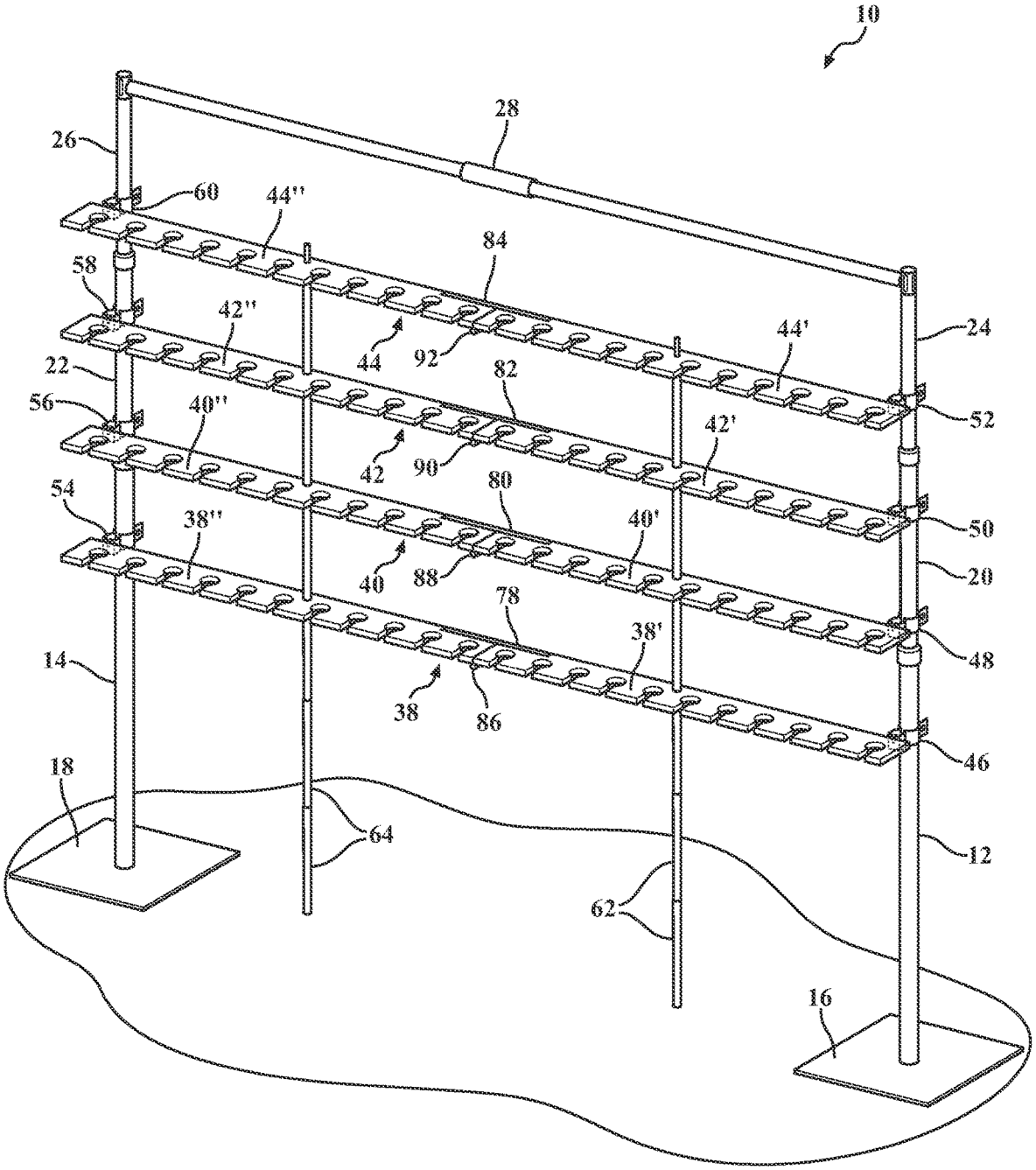
FIG. 2 is a perspective view depicting the multiple components of the assembleable beverage wall frame.
Figure 3:
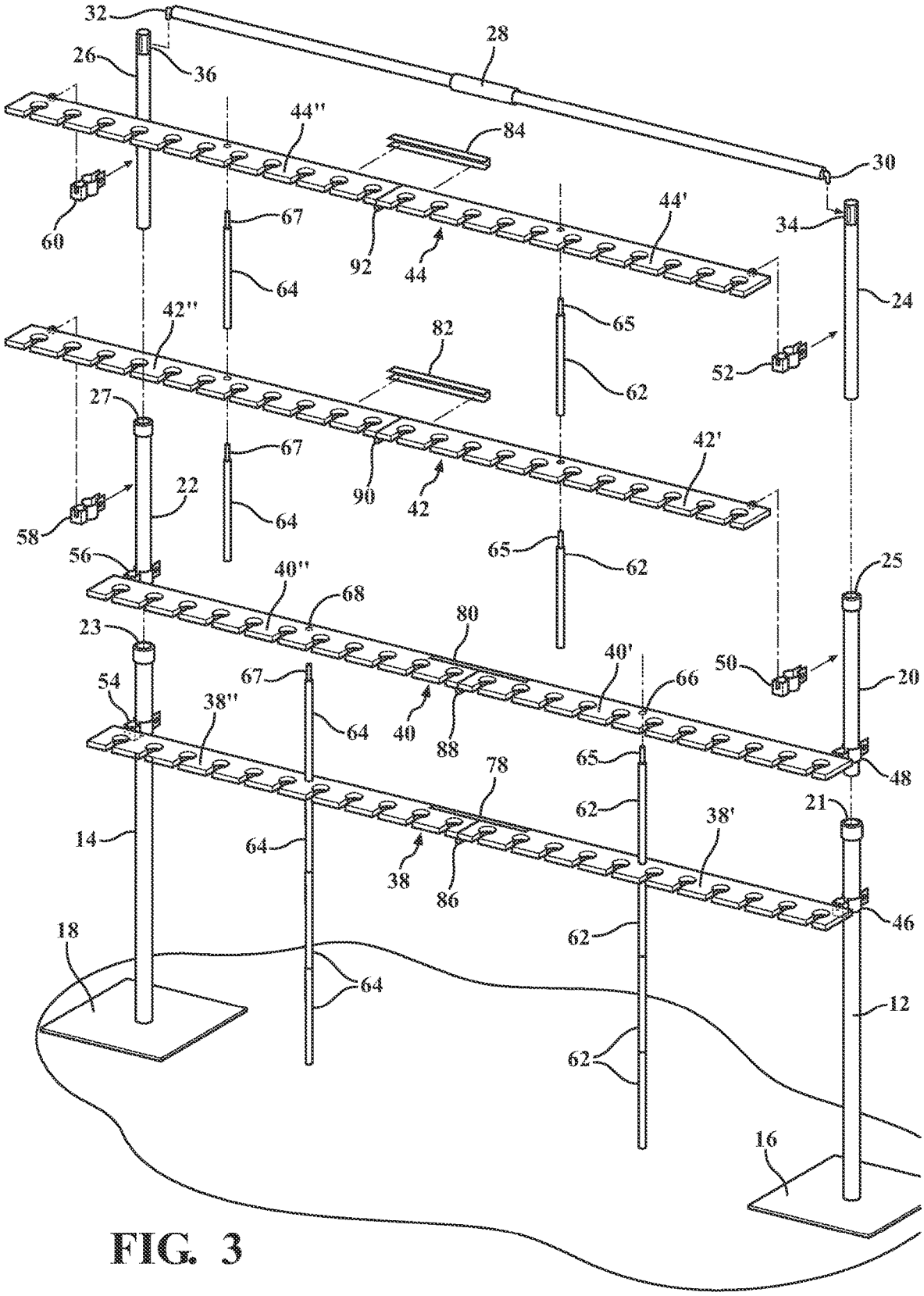
FIG. 3 is an exploded view of the frame of FIG. 2 and better illustrating the arrangement of shelving sections, supports and clamps.
Figure 4:
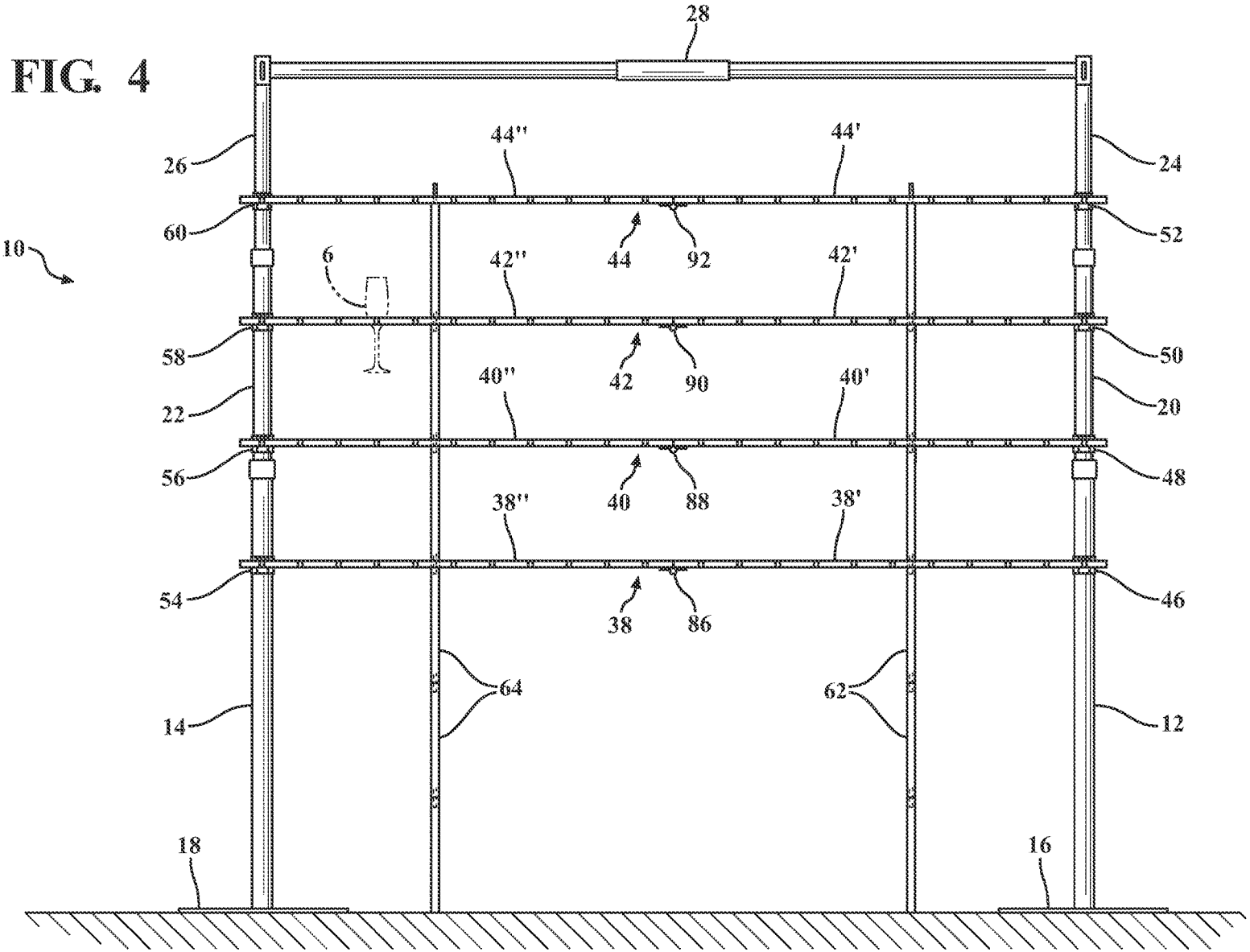
FIG. 4 is a front plan view illustration of FIG. 2 and depicting the manner of supporting a selected champagne flute.

FIG. 2 is a perspective view depicting the multiple components of the assembleable beverage wall frame, with FIG. 3 providing an exploded view of the frame of FIG. 2 and better illustrating the arrangement of shelving sections, supports and clamps and FIG. 4 a front plan view illustration of FIG. 2 and depicting the manner of supporting a selected champagne flute;

A pair of inter assemble-able outer or end tubular or framing sections are provided (such being constructed of any suitable material), with each including a lower-most section 12 and 14 with pedestal base support 16 and 18. Additional intermediate 20/22 and upper 24/26 tubular sections are engaged to the lower-most sections 12/14.

As best shown in FIG. 3, the lower 12/14 and intermediate 20/22 tubular sections can each include without limitation hollow tubular members with enlarged end collars (see at 21/23 for sections 12/14 and 25/27 for sections 20/22) which resistively engage opposing circular inserting ends of the intermediate 220/22 and uppermost 24/26 succeeding tubular sections. Without limitation, outer tubular sections can alternatively be reconfigured to each include only two inter-assembleable and stacked sections or can be designed to include a greater plurality than the three sections shown. It is also envisioned and understood that the end tubular sections can alternatively be constructed as telescoping subassemblies, and which can be collapsed during non-use or shipping/transport.

An upper-most horizontal interconnecting support 28 extends between the uppermost tubular sections 24/26 of the end supports (see also angled end hooks 30/32 which engaged upper end located assembly slots 34/36 configured into the upper-most sections 24/26).

A plurality of horizontal and width extending shelving sections are depicted, see at 38, 40, 42 and 44, for supporting the food or beverage items in a tiered arrangement and which are attached via configured clamps, see at 46, 48, 50 and 52 for securing the shelving sections to a first of the end tubular sections, as well as at 54, 56, 58 and 60 for securing the shelving sections to the other of the end tubular sections. Additional intermediate located and inter assemble-able vertical pole supports, see individual pluralities of several each at 62 and 64 are provided which interconnect through aligning apertures (by example referenced at 66 and 68 for selected shelf 40 in FIG. 2) configured in each of the vertically spaced and tier defining shelves or individual shelving sections 38, 40, 42 and 44, with the lowest pole supports 66/68 contacting the ground or floor as shown in FIG. 2, in order to provide reinforcing support to the overall assembly. As best shown in FIG. 3, the pole supports include narrowed upper diameter projecting portions (see at 65 and 67 for selected pole supports 62/64) which are frictionally engaged with underside pockets (not shown) configured in succeeding stacked pole supports.

Figure 5:
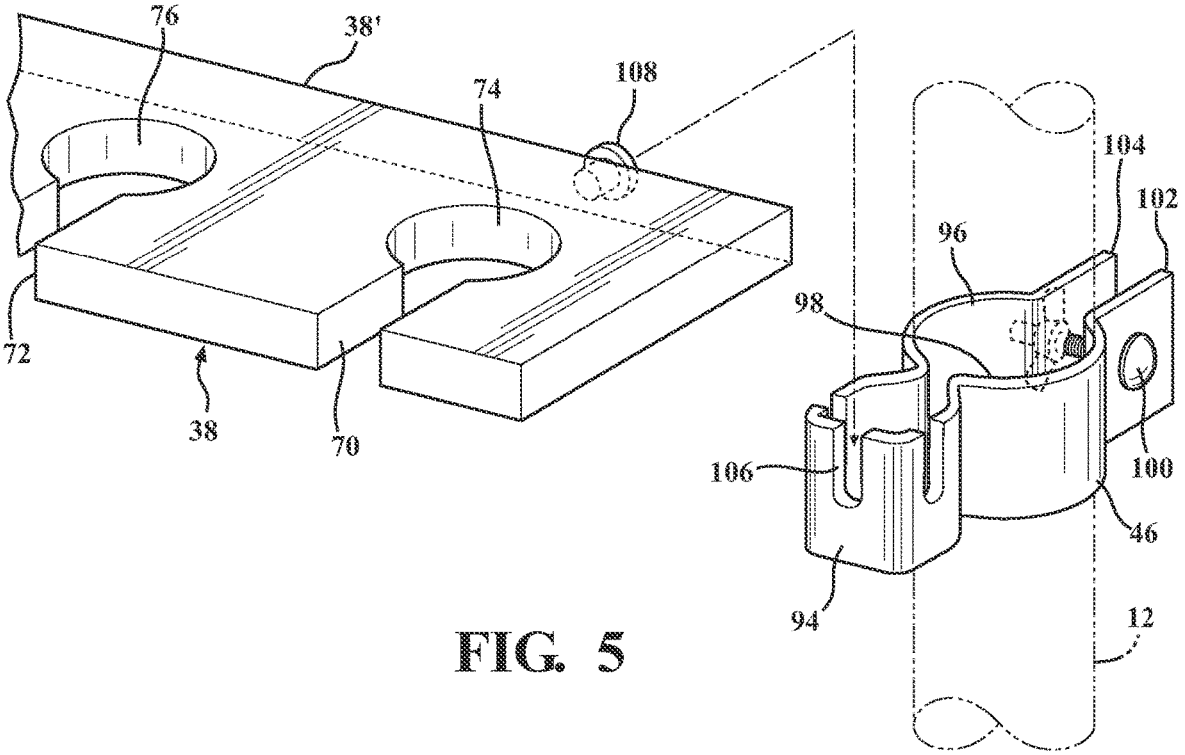
FIG. 5 is an enlarged partial illustration depicting in exploded view the engagement of a vertical tubular support and clamp to a shelf-defining tier of the assembly.
Figure 6:
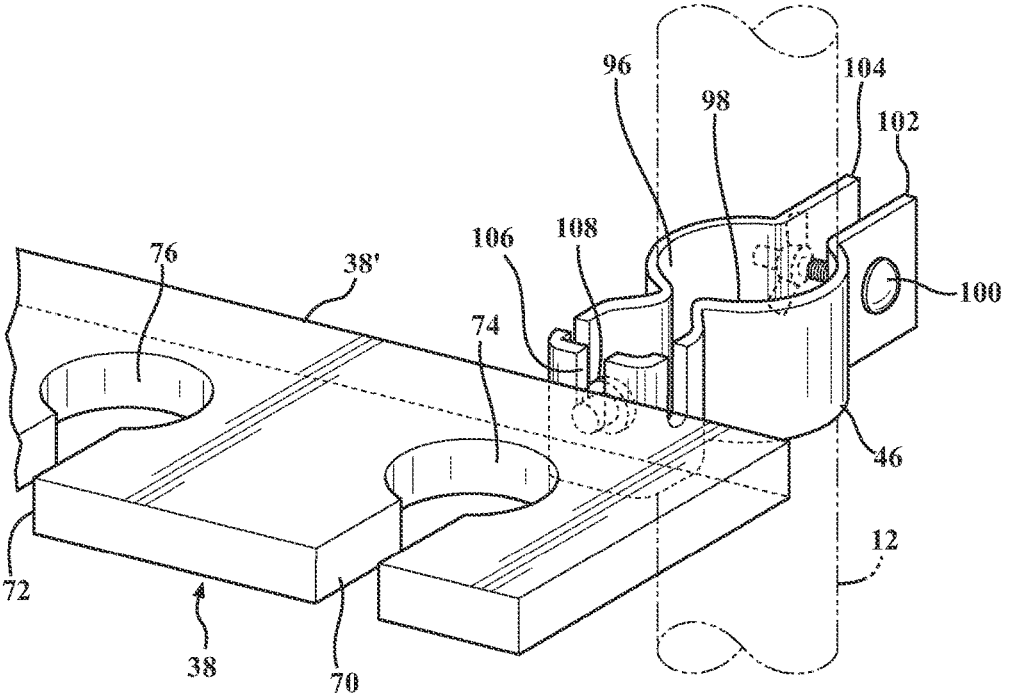
FIG. 6 is a succeeding assembled illustration of the arrangement shown in FIG. 5.
Figure 7:
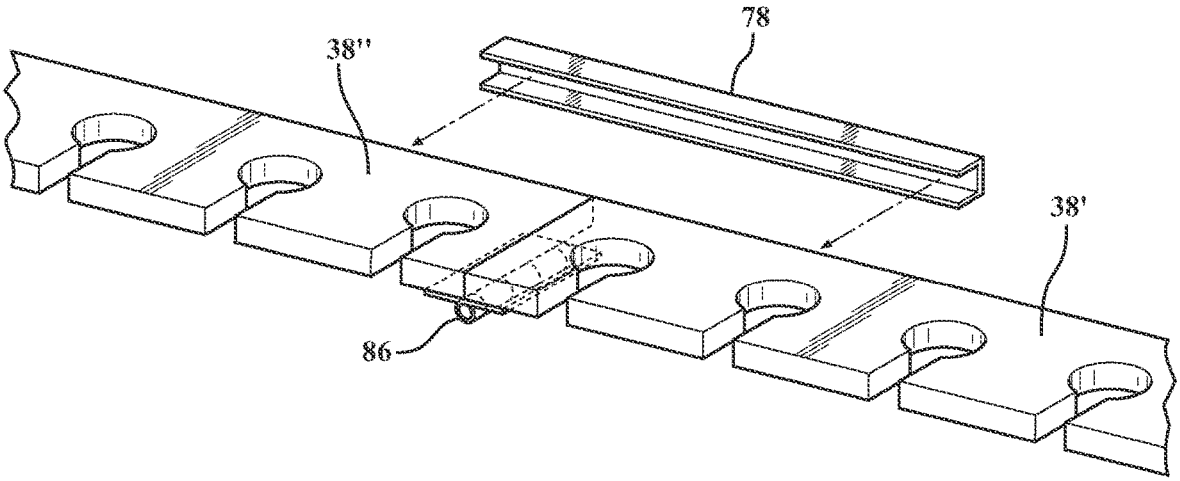
FIG. 7 is an enlarged partial illustration depicting in exploded view the engagement of a horizontal reinforcing track to end-to-end aligned shelf defining tier sections.
Figure 8:
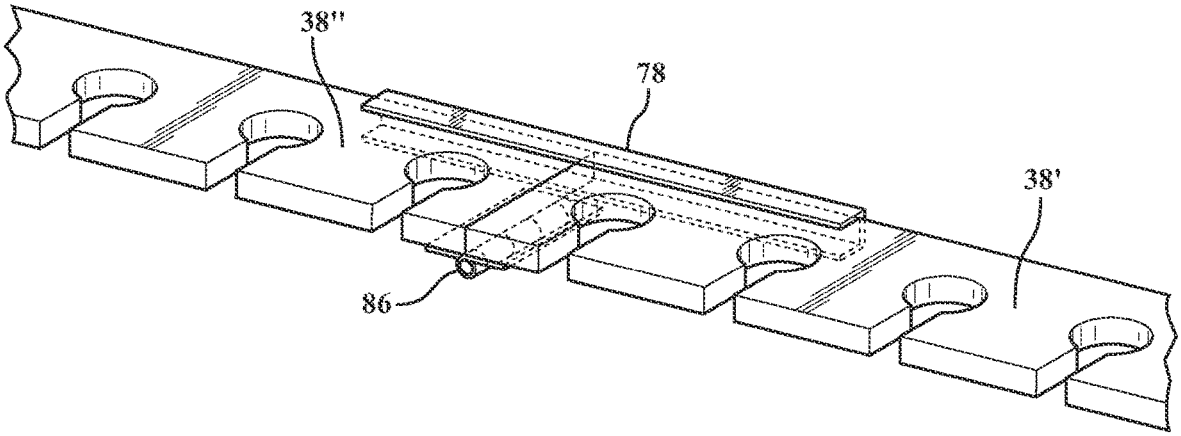
FIG. 8 is a succeeding assembled illustration of the arrangement shown in FIG. 7.

The individual shelving sections can be designed in any suitable fashion in order support any desired item for acquisition by guests or participants of the event and, in a non-limiting preferred embodiment, can include forward-most notches, see at 70, 72, et seq. in FIG. 5-6, which communication with interior spaced apart circular cutouts, further at 74 and 76 for selected shelving section 38 for supporting a plurality of such as the champagne flutes 6.

As is further shown, each of the individually tiered shelving sections can be further provided in subdivided and end-to-end inter-connected sub-sections (see at 38738", 40740", 42'/42" and 44'/44" corresponding to shelf sections 38, 40, 42 and 44), this with the assistance of horizontal reinforcing and "U" shaped tracks, see as shown at 78, 80, 82 and 84, which frictionally engaged along rear interconnected edges of the shelf sub-sections. This is best depicted in the enlarged partial views of FIGS. 7-8, and functions both to assist in reducing the overall length of the shipped assembly as well as to provide the necessary structural support when assembled. In a preferred variant, the subdivided tier sections can be pivotally attached (see underside located hinge brackets 86, 88, 90 and 92) so as to be rotated between a reduced length storage or transport configuration and an assembled and extended use position.

FIG. 5 is an enlarged partial illustration depicting in exploded view the attachment of selected clamp 46 to the vertical tubular support section 12 and shelf-defining tier sub-section 38' of the assembly, with FIG. 6 providing a succeeding assembled illustration of the arrangement shown in FIG. 5. Each of the clamps, such as constructed of a flexible metal or heavy duty polymeric material, exhibits a pair of spaced apart flange portions which are joined at a base (see at 94 for clamp 46).

The flange portions each define a semi-circular configuration (see at 96 and 98) which is flexibly applied around the tubular sub-section 12, following which a fastener 100 is inserted through integral planar end portions 102/104 of the flange portions and, upon tightening, to affix the bracket to the tubular section. A channel 106 or other shaped aperture is formed in the end face of the clamp base 94 and which, upon positioning in alignment with an aperture configured in a rear surface location of the shelf sub-section 38', receives a further mounting fastener 108 for affixing the ends of the shelf to each of the primary end tubular sections.

Figure 9:
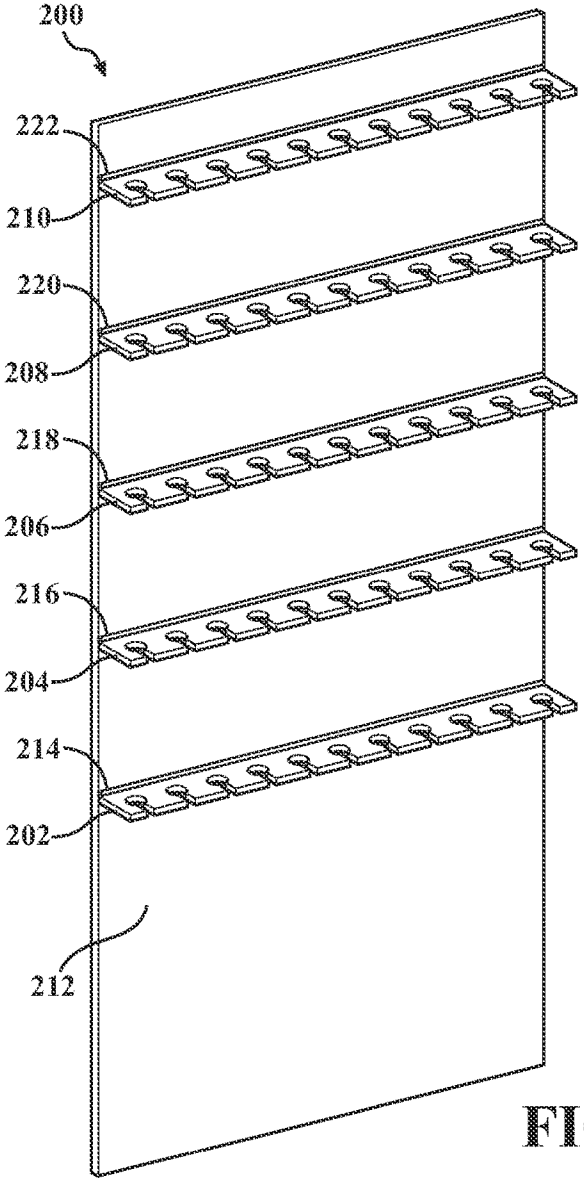
FIG. 9 is a perspective illustration of a food or beverage wall according to a further embodiment and which discloses a plurality of pivotally supported shelfs relative to a rigid supported backboard.
Figure 10:
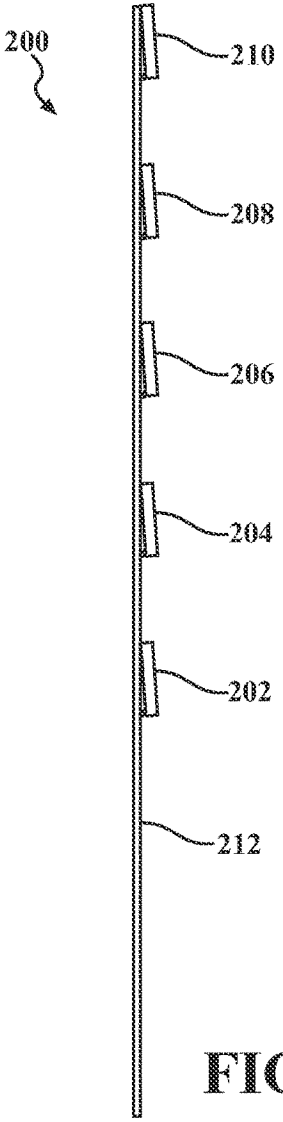
FIG. 10 is a rotated side view illustration of the assembly in FIG. 9 with the shelves pivoted to a stored position.

With reference now to FIG. 9, a food or beverage wall is shown at 200 according to a further embodiment discloses a plurality of pivotally supported shelfs 202, 204, 206, 208 and 210 relative to a rigid supported backboard 212. As shown, the shelves are pivoted between stored (see FIG. 10) and use (FIG. 12) positions.

Figure 11:
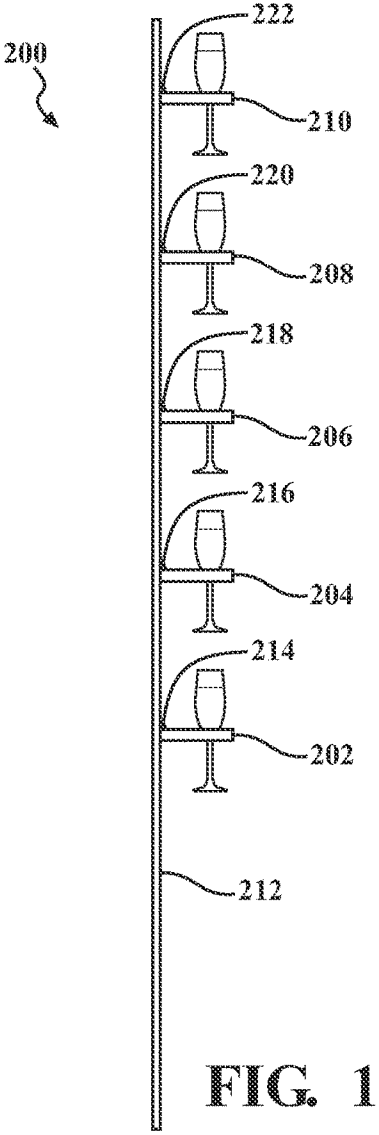
FIG. 11 is an illustration similar to FIG. 10 with the shelves pivoted to a use position and supporting tiered champagne flutes according to one non-limiting use application.

The shelves 202-210 can be similarly configured for receiving such as champagne flutes 6 when rotated in the downwardly pivoted use position. The shelves can be folded, typically upwardly, in a non-use or stored position, which also minimizes the cross sectional profile for providing ease of shipping. Without limitation, a set of hinge brackets 214, 216, 218, 220 and 222 correspond to the shelfs 202, 204, 206, 208 and 210 and are configured such that the shelfs can be rotated between the upward stored position of FIG. 10 and the downwardly pivoted use arrangement of FIG. 11.

Referring now to FIG. 12, a perspective illustration is generally shown at 300 of a food or beverage wall assembly kit according to a further embodiment and which discloses a redesigned rigid supporting backboard 302, with horizontal extending recessed tracks 304, 306, 308, 310 and 312, within which is slidably engaged each of slidably engaged tier defining shelves at 314, 316, 318, 320 and 322. The shelves each include without limitation cutouts as previously described for supporting such as champagne flutes.

Enlarged partial view illustrations are shown in FIGS. 12A and 12B and depict, respectively, each of dovetail shaping and horizontal recessed shaping of the tracks, as well as mating engaging dovetail rear end profiles (see at 324 for selected shelving section 314) configured for each of the shelving sections. The dimensioning of the mating dovetail arrangement shown (and which can include any other suitable profile) ensures secure engagement of the shelving sections as they are slidably and frictionally engaged within their respective tracks.

The rigid backboard embodiments of FIGS. 9 and 12 can be configured to be suspended against a wall surface. Alternatively, and although not shown, it is also envisioned that bottom pedestal brackets can be provided for supporting the assembly upon a floor surface.

Figure 13:
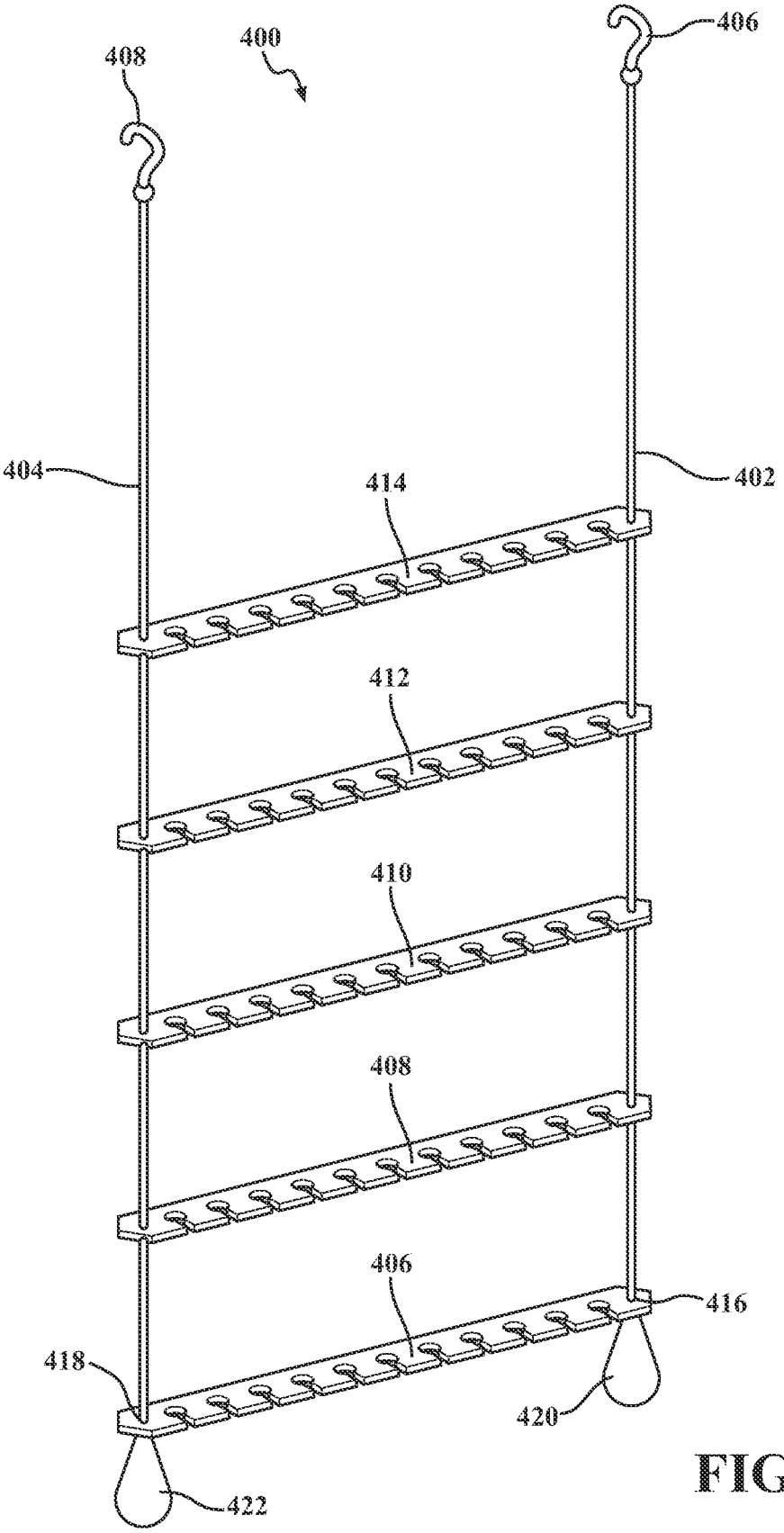
FIG. 13 is a further perspective illustration of a food or beverage wall according to a further embodiment and which discloses a pair of spaced apart and vertical lanyards to hang in a suspended position from a pole or fixed structure between which are secured redesigned flute supporting shelves.

Finally, FIG. 13 is a further perspective illustration, generally at 400, of a food or beverage wall assembly kit according to a further embodiment and which discloses a pair of spaced apart and vertical lanyards 402 and 404 which engage to hang in a suspended position from a pole or fixed structure at upper ends, such as via hooks 406 and 408, and between which are secured redesigned flute supporting shelves 406, 408, 410, 412 and 414. The lanyards 402/404 can include any of flexible or semi-flexible rope or line, as well as alternatively being constructed as rigid extending rods.

The redesigned shelves 406-414 include similar cutout configurations as previously described for supporting the individual champagne flutes and can again be alternatively redesigned for supporting and presenting any desired item in multiple and tiered fashion. Without limitation, apertures are formed in each of the shelves (see at 416 and 418 for lowermost shelf 406) and through which the lanyards or rods 402/404 can be frictionally engaged. Alternatively, the lanyards can include underside collars or other embossments (not shown) which function to support and orient the shelves in the horizontally arrayed fashion as depicted. Swaying of the assembly can be attenuated by the inclusion of weighted, typically decorative, fobs 420/422 at the lowermost ends of the lanyards/rods 402/404.

Having described my invention, other and additional preferred embodiments will become apparent to those skilled in the art to which it pertains, and without deviating from the scope of the appended claims. The detailed description and drawings are further understood to be supportive of the disclosure, the scope of which being defined by the claims. While some of the best modes and other embodiments for carrying out the claimed teachings have been described in detail, various alternative designs and embodiments exist for practicing the disclosure defined in the appended claims.

The foregoing disclosure is further understood as not intended to limit the present disclosure to the precise forms or particular fields of use disclosed. As such, it is contemplated that various alternate embodiments and/or modifications to the present disclosure, whether explicitly described or implied herein, are possible in light of the disclosure. Having thus described embodiments of the present disclosure, a person of ordinary skill in the art will recognize that changes may be made in form and detail without departing from the scope of the present disclosure. Thus, the present disclosure is limited only by the claims.

In the foregoing specification, the disclosure has been described with reference to specific embodiments. However, as one skilled in the art will appreciate, various embodiments disclosed herein can be modified or otherwise implemented in various other ways without departing from the spirit and scope of the disclosure. Accordingly, this description is to be considered as illustrative and is for the purpose of teaching those skilled in the art the manner of making and using various embodiments of the disclosure. It is to be understood that the forms of disclosure herein shown and described are to be taken as representative embodiments. Equivalent elements, materials, processes or steps may be substituted for those representatively illustrated and described herein. Moreover, certain features of the disclosure may be utilized independently of the use of other features, all as would be apparent to one skilled in the art after having the benefit of this description of the disclosure. Expressions such as "including", "comprising", "incorporating", "consisting of", "have", "is" used to describe and claim the present disclosure are intended to be construed in a non-exclusive manner, namely allowing for items, components or elements not explicitly described also to be present. Reference to the singular is also to be construed to relate to the plural.

Further, various embodiments disclosed herein are to be taken in the illustrative and explanatory sense, and should in no way be construed as limiting of the present disclosure. All joinder references (e.g., attached, affixed, coupled, connected, and the like) are only used to aid the reader's understanding of the present disclosure, and may not create limitations, particularly as to the position, orientation, or use of the systems and/or methods disclosed herein. Therefore, joinder references, if any, are to be construed broadly. Moreover, such joinder references do not necessarily infer that two elements are directly connected to each other.

Additionally, all numerical terms, such as, but not limited to, "first", "second", "third", "primary", "secondary", "main" or any other ordinary and/or numerical terms, should also be taken only as identifiers, to assist the reader's understanding of the various elements, embodiments, variations and/or modifications of the present disclosure, and may not create any limitations, particularly as to the order, or preference, of any element, embodiment, variation and/or modification relative to, or over, another element, embodiment, variation and/or modification.

It will also be appreciated that one or more of the elements depicted in the drawings/figures can also be implemented in a more separated or integrated manner, or even removed or rendered as inoperable in certain cases, as is useful in accordance with a particular application. Additionally, any signal hatches in the drawings/figures should be considered only as exemplary, and not limiting, unless otherwise specifically specified.

The invention claimed is:

1. An assembly kit for constructing an item supporting wall, comprising:

a pair of vertically extending framing sections with pedestal base supports;

a plurality of horizontally arrayed and tier defining shelves assembled in extending fashion between said framing sections, said shelves adapted for supporting items;

said vertically extending framing sections further including a pair of inter assemble-able tubular sections including a lower-most section connected to said pedestal base support, with at least one of intermediate and upper tubular connected sections;

said lower-most and intermediate tubular sections further including hollow tubular members with enlarged end collars which resistively engage opposing circular inserting ends of corresponding upper succeeding tubular sections from said a pair of inter assemble-able tubular sections;

the items further including champagne flutes, said shelves each further having forward-most notches that extend rearwardly to circular cutouts that are adapted to receive the champagne flutes; and at least one stacked plurality of intermediate located and inter assemble-able vertical pole supports which interconnect through aligning apertures in the shelves to provide reinforcing support.

2. The assembly kit as described in claim 1, each of said stacked plurality of pole supports further comprising a narrowed upper diameter projecting portion frictionally engaged with an opposing underside pocket in a corresponding successively engaged pole support from said at least one stacked plurality of vertical pole supports.

3. The assembly kit as described in claim 1, further comprising an upper-most horizontal interconnecting support extending between said upper tubular sections.

4. The assembly kit as described in claim 3, said upper-most horizontal support further comprising angled end hooks which engaged upper end located assembly slots configured into said upper tubular sections.

5. The assembly kit as described in claim 1, further comprising clamps for securing to said inter-assembleable tubular sections.

6. The assembly kit as described in claim 5, further comprising each of said clamps being constructed of a flexible metal or heavy duty polymeric material and exhibiting a pair of spaced apart flange portions which are joined at a base.

7. The assembly kit as described in claim 6, said flange portions each further comprising a semi-circular configuration which is flexibly applied around said tubular sections, a fastener subsequently inserting through integral planar end portions and, upon tightening, affixing the bracket to said tubular sections.

8. The assembly kit as described in claim 7, further comprising a channel formed in an end face of said clamp base and, upon positioning in alignment with an aperture configured in a rear surface location of a selected one of said shelves, receiving a second fastener for affixing an end of said shelf to each of said outer tubular sections.

9. The assembly kit as described in claim 1, said shelves each further comprising individual and hingedly attached sub-sections.

10. The assembly kit as described in claim 9, further comprising horizontal reinforcing and "U" shaped tracks, which frictionally engaged along rear interconnected edges of the shelf sub-sections.

11. An assembly kit for constructing an item supporting wall, comprising:

a pair of vertically extending framing sections with pedestal base supports;

a plurality of horizontally arrayed and tier defining shelves assembled in extending fashion between said framing sections, said shelves adapted for supporting items;

said shelves each further including individual and hingedly attached sub-sections; and at least one stacked plurality of intermediate located and inter assemble-able vertical pole supports which interconnect through aligning apertures in the shelves to provide reinforcing support.

12. The assembly kit as described in claim 11, further comprising horizontal reinforcing and "U" shaped tracks, which frictionally engaged along rear interconnected edges of the shelf sub-sections.

13. An assembly kit for constructing an item supporting wall, comprising:

a pair of vertically extending framing sections with pedestal base supports;

a plurality of horizontally arrayed and tier defining shelves assembled in extending fashion between said framing sections, said shelves adapted for supporting items;

said vertically extending framing sections further comprising a pair of inter assemble-able tubular sections including a lower-most section connected to said pedestal base supports, with at least one of intermediate and upper tubular connected sections;

said lower-most and intermediate tubular sections further including hollow tubular members with enlarged end collars which resistively engage opposing circular inserting ends of corresponding upper succeeding tubular sections from said a pair of inter assemble-able tubular sections; and at least one stacked plurality of intermediate located and inter assemble-able vertical pole supports which interconnect through aligning apertures in the shelves to provide reinforcing support.

14. The assembly kit as described in claim 13, further comprising clamps for securing to said inter-assembleable tubular sections.

15. The assembly kit as described in claim 14, further comprising each of said clamps being constructed of a flexible metal or heavy duty polymeric material and exhibiting a pair of spaced apart flange portions which are joined at a base.

16. The assembly kit as described in claim 15, said flange portions each further comprising a semi-circular configuration which is flexibly applied around said tubular sections, a fastener subsequently inserting through integral planar end portions and, upon tightening, affixing the bracket to said tubular sections.

17. The assembly kit as described in claim 16, further comprising a channel formed in an end face of said clamp base and, upon positioning in alignment with an aperture configured in a rear surface location of a selected one of said shelves, receiving a second fastener for affixing an end of said shelf to each of said outer tubular sections.

* * * * *